US010799919B2

(12) United States Patent
Liao

(10) Patent No.: US 10,799,919 B2
(45) Date of Patent: Oct. 13, 2020

(54) WASHING DEVICE

(71) Applicant: G-WINNER ENVIRONMENTAL PROTECTION CO., LTD., Taichung (TW)

(72) Inventor: Ping-Yuan Liao, Taichung (TW)

(73) Assignee: G-WINNER ENVIRONMENTAL PROTECTION CO., LTD., Taichung (TW)

( * ) Notice: Subject to any disclaimer, the term of this patent is extended or adjusted under 35 U.S.C. 154(b) by 272 days.

(21) Appl. No.: 15/900,090

(22) Filed: Feb. 20, 2018

(65) Prior Publication Data

US 2018/0333754 A1 Nov. 22, 2018

(30) Foreign Application Priority Data

May 22, 2017 (TW) ..... 106207296 U

(51) Int. Cl.

| | |
|---|---|
| ***B08B 3/10*** | (2006.01) |
| ***F26B 21/00*** | (2006.01) |
| *D06F 31/00* | (2006.01) |
| *F26B 5/00* | (2006.01) |

(52) U.S. Cl.

CPC ..... *B08B 3/10* (2013.01); *F26B 21/004* (2013.01); *D06F 31/00* (2013.01); *F26B 5/00* (2013.01)

(58) Field of Classification Search

CPC .. B08B 3/022; B08B 3/10; B08B 3/04; H01L 21/67034; F26B 21/004; F26B 21/006; F26B 21/00

See application file for complete search history.

(56) References Cited

U.S. PATENT DOCUMENTS 2,861,673 A * 11/1958 Sandganger ..... B65G 37/00 198/626.4
3,272,176 A * 9/1966 Saydlowski ..... D06B 15/09 118/63

(Continued)

FOREIGN PATENT DOCUMENTS

CN 202924348 U * 5/2013
WO WO-2018072464 A1 * 4/2018 ..... F26B 21/001

OTHER PUBLICATIONS

Machine translation of CN-202924348-U, dated May 2013. (Year: 2013).*

*Primary Examiner* — Michael E Barr
*Assistant Examiner* — Kevin G Lee
(74) *Attorney, Agent, or Firm* — Muncy, Geissler, Olds & Lowe, P.C.

(57) ABSTRACT

A washing device includes a main body, a water system, and a drying system. The main body includes a first washing zone, a second washing zone, and a drying zone. A transporting device transports an object to make it pass through the first washing zone, the second washing zone, and the drying zone. The first washing zone has a first water outlet, and the second washing zone has a second water outlet. The water system includes a heater for heating water and a tank. A first pipe connects the heater and the first water outlet, and a second pipe connects the heater and the tank. An outlet pipe connects the tank and the second water outlet. A collecting structure collects waste water and injects into the tank. The drying system is adapted to supply air flow to the drying zone for drying the object.

9 Claims, 6 Drawing Sheets

(56) References Cited

U.S. PATENT DOCUMENTS

| | | | | |
|---|---|---|---|---|
| 3,963,115 | A * | 6/1976 | Teske | B65G 43/02 198/718 |
| 4,017,982 | A * | 4/1977 | Goffredo | F26B 3/04 34/464 |
| 4,396,435 | A * | 8/1983 | West | H01M 4/04 134/10 |
| 6,293,196 | B1 * | 9/2001 | DeMoore | B41F 23/0426 101/424.1 |
| 6,446,358 | B1 * | 9/2002 | Mitsumori | F26B 13/28 34/230 |
| 2011/0094544 | A1 * | 4/2011 | Fabin | A47L 15/4297 134/104.2 |
| 2012/0006485 | A1 * | 1/2012 | Tanabe | B08B 3/022 156/345.11 |
| 2015/0320288 | A1 * | 11/2015 | Anim-Mensah | A47L 15/4291 134/19 |

* cited by examiner

WASHING DEVICE

BACKGROUND OF THE INVENTION

Field of the Invention

The present invention relates to a washing device.

Description of the Prior Art

Generally, a commercial washing process includes a step of washing and a step of drying. Objects to be washed are placed into a washing machine for washing. The washed objects are taken out manually and placed into a drying machine for drying. The dried objects are also taken out manually. Thus, the process is time-consuming and complicated, and the cleaned objects may be contaminated again by human.

Besides, the objects are usually stacked together in the washing machine or the drying machine. Thus, some objects may not be cleaned or dried sufficiently.

SUMMARY OF THE INVENTION

The main object of the present invention is to provide a washing device which is able to complete the steps of washing and drying continuously.

To achieve the above and other objects, a washing device of the present invention includes a main body, a water system, and a drying system.

The main body has a first end and a second end and includes a first washing zone, a second washing zone, and a drying zone from the first end to the second end. The main body has a transporting device to transport an object to be washed from the first end toward the second end so that the object to be washed passes through the first washing zone, the second washing zone, and the drying zone. The first washing zone has at least one first water outlet, and the second washing zone has at least one second water outlet.

The water system includes a heater, a tank, a first pipe, a second pipe, and a collecting structure. The heater is connected to a water source to heat up water. The first pipe and the second pipe are connected to the heater respectively. An other end of the first pipe is connected to the tank, and the tank is connected to the first water outlet via an outlet pipe. An other end of the second pipe is connected to the second water outlet. The collecting structure collects waste water from the first washing zone and the second washing zone and injects into the tank.

The drying system includes an air supplier and at least one venting device. The venting device is arranged at the drying zone of the main body and is connected to the air supplier so as to supply air flow to the drying zone for drying the object to be washed.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
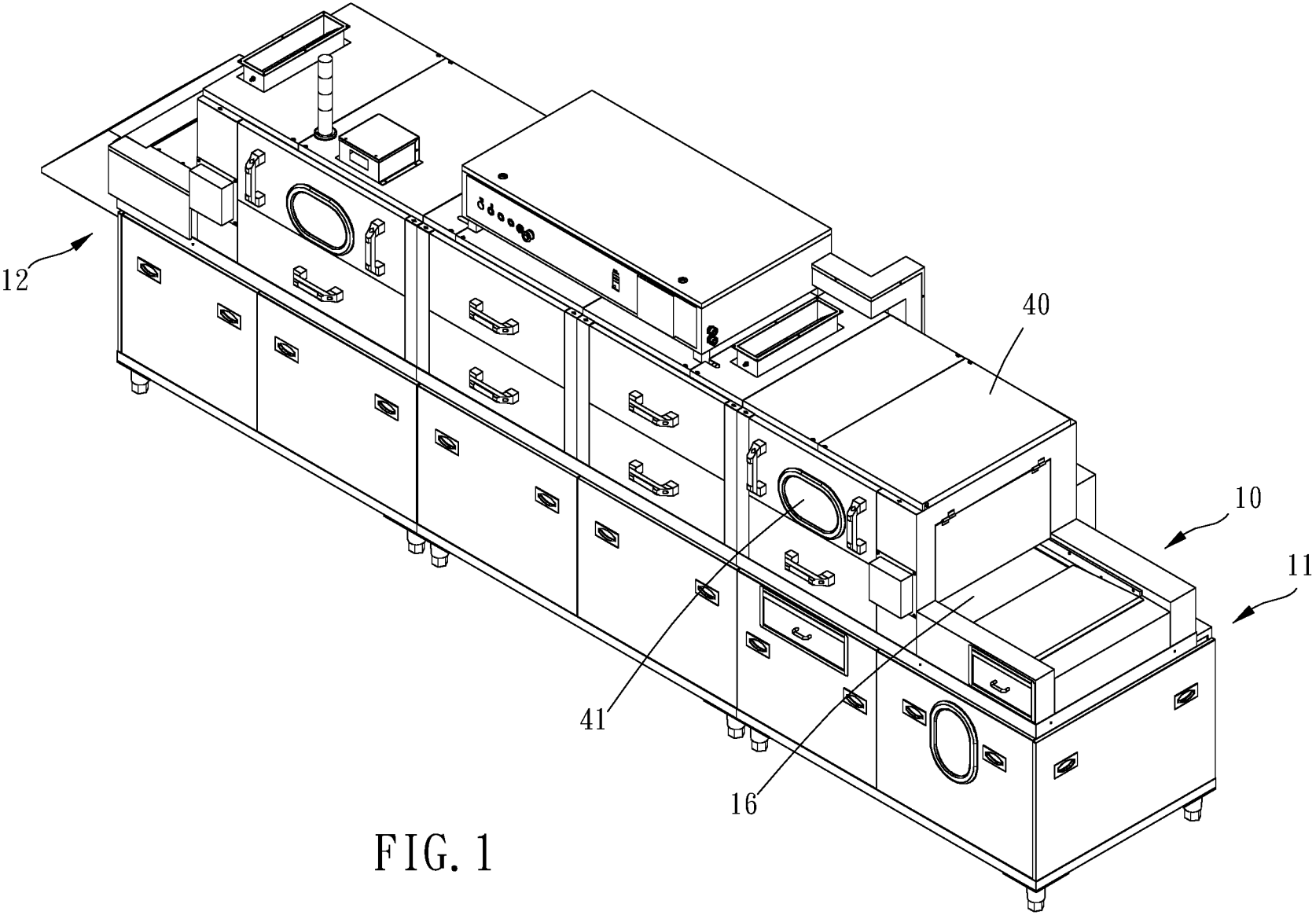
FIG. 1 and FIG. 2 are stereograms of the present invention.
Figure 2:
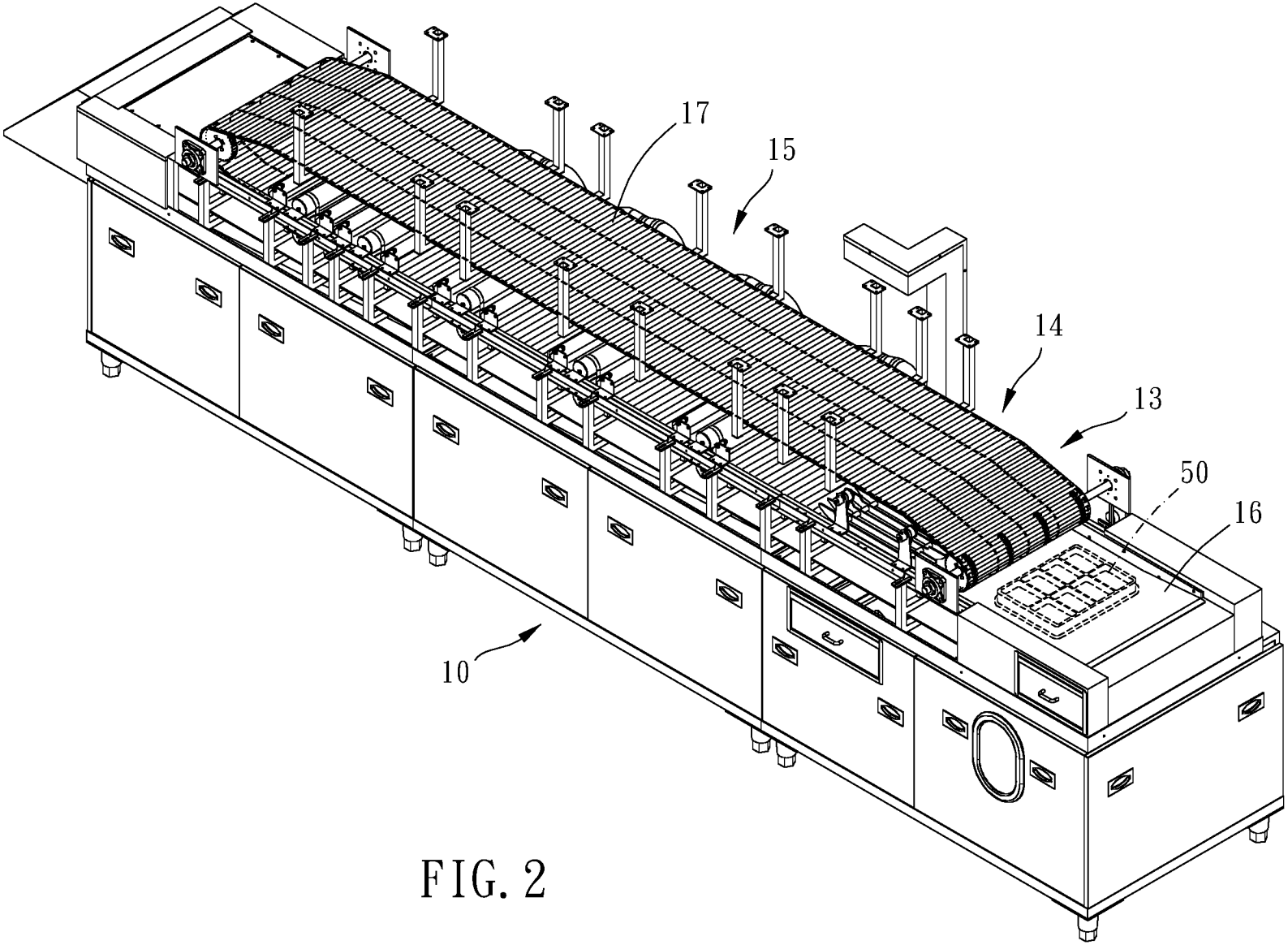
Figure 3:
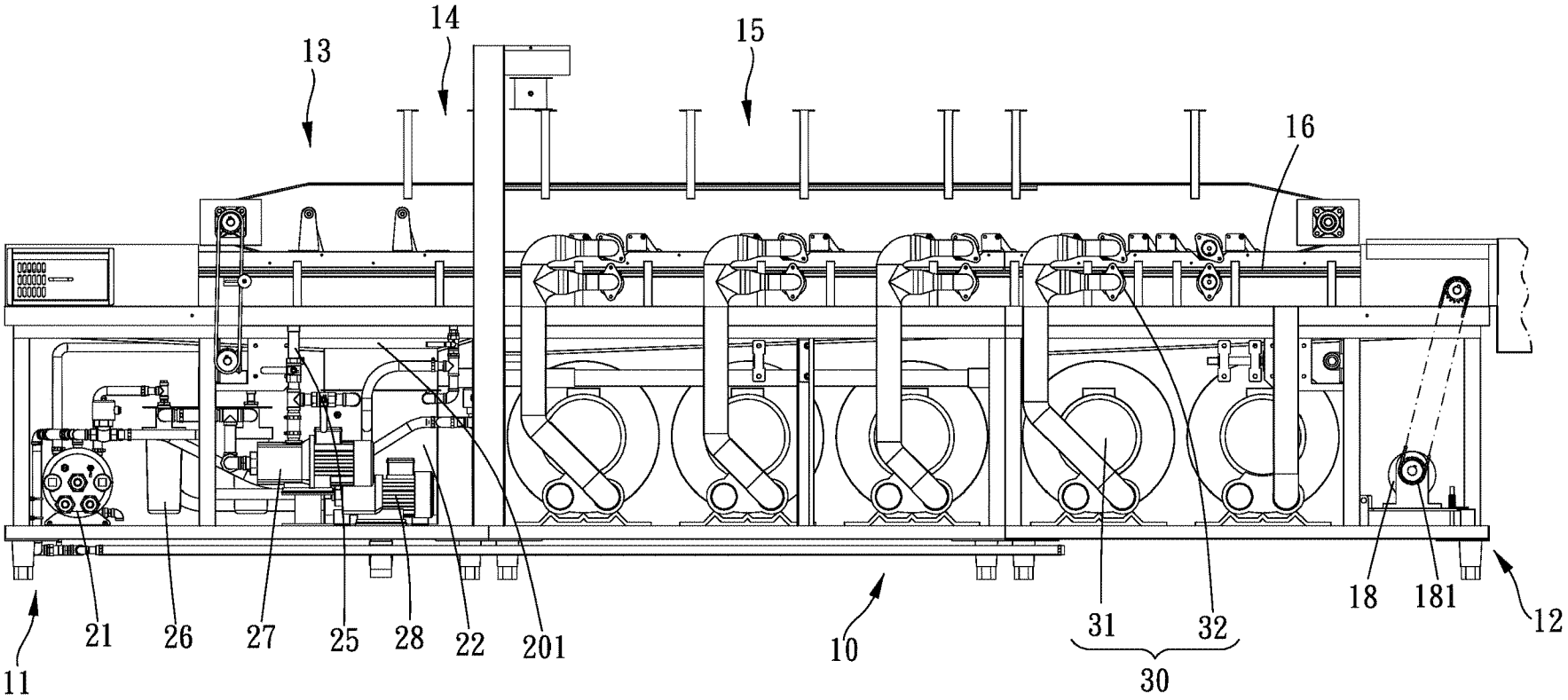
FIG. 3 is a lateral view of the present invention.
Figure 4:
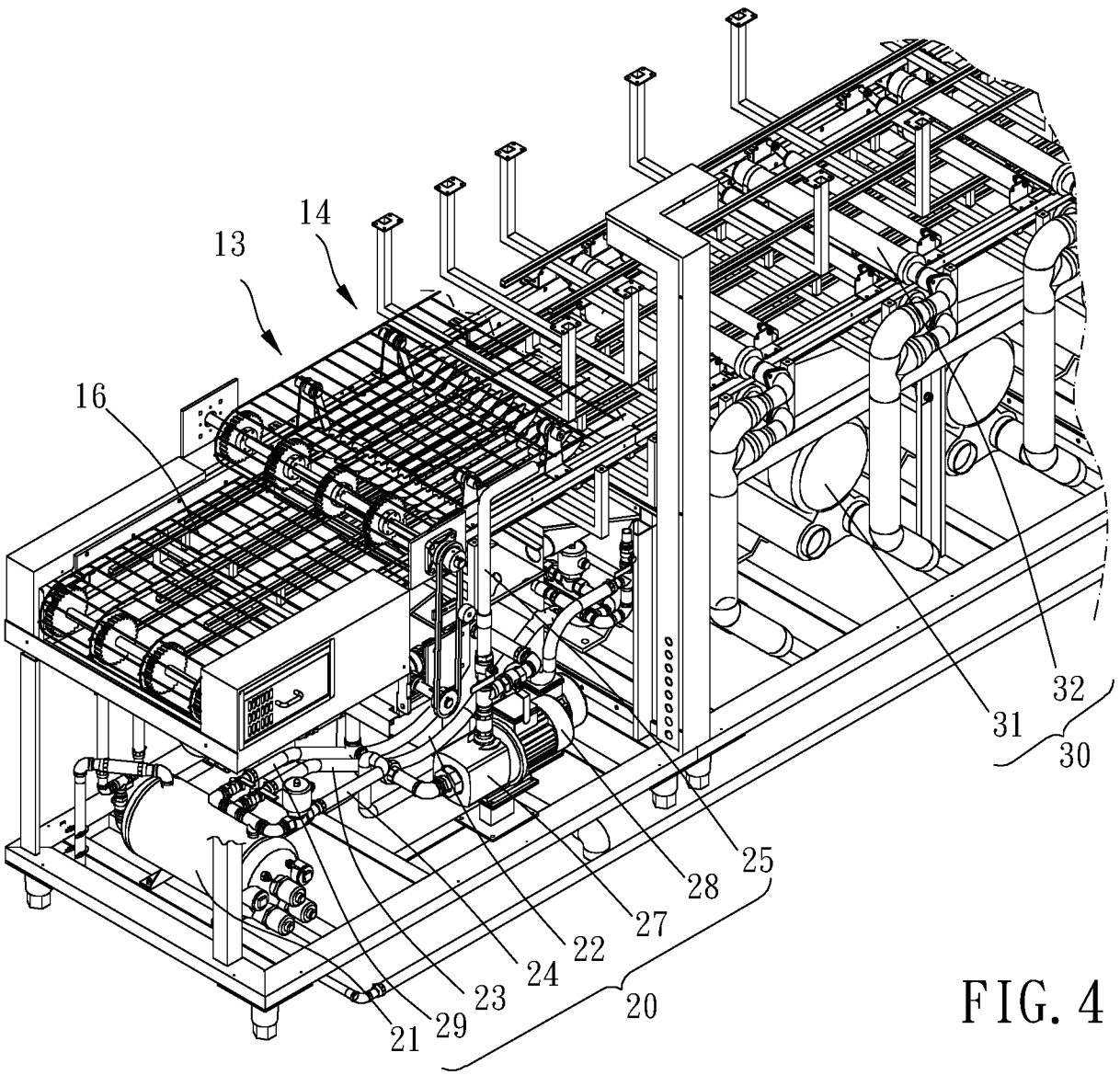
FIG. 4 is a stereogram showing a water system and a drying system of the present invention.

Please refer to FIG. 1 to FIG. 7, the washing device of the present invention includes a main body 10, a water system 20, and a drying system 30.

The main body 10 has a first end 11 and a second end 12. The main body 10 includes a first washing zone 13, a second washing zone 14, and a drying zone 15 from the first end 11 to the second end 12. The main body 10 has a transporting device to transport an object to be washed 50 from the first end 11 toward the second end 12 so that the object to be washed 50 passes through the first washing zone 13, the second washing zone 14, and the drying zone 15. The first washing zone 13 has at least one first water outlet, and the second washing zone 14 has at least one second water outlet.

The water system 20 includes a heater 21, a tank 22, a first pipe 23, a second pipe 24, and a collecting structure 201. The heater 21 is connected to a water source to heat up water. The first pipe 23 and the second pipe 24 are connected to the heater 21 respectively. An other end of the first pipe 23 is connected to the tank 22. The tank 22 is connected to the first water outlet via an outlet pipe 25. An other end of the second pipe 24 is connected to the second water outlet. The collecting structure 201 collects waste water from the first washing zone 13 and the second washing zone 14 and then injects into the tank 22.

The drying system 30 includes an air supplier 31 and at least one venting device 32. The venting device 32 is arranged at the drying zone 15 of the main body 10 and is connected to the air supplier 31 so as to supply air flow to the drying zone 15 for drying the object to be washed 50.

In the present embodiment, the water system 20 further includes a filtering device 26, a first motor 27, and a second motor 28. The filtering device 26 and the first motor 27 are disposed on the outlet pipe 25. The second motor 28 is disposed on the second pipe 24. The tank 22 has a water level detector. When water level is higher than a predetermined amount, the water level detector triggers the first pipe 23 to close to prohibit water from flowing into the tank 22 from the heater 21. Preferably, the water system 20 further includes third pipe 29 which is independent from the first pipe 23. The third pipe 29 connects the heater 21 and the tank 22 therebetween in order to manually add more water into the tank 22 from the heater 21.

Besides, the transporting device includes a conveyor 16 and a pressing net 17. The pressing net 17 is rollably arranged (by rollers in the present embodiment) above the conveyor 16 to press the object to be washed 50 to move following the conveyor 16. Specifically, the transporting device further includes a motor 18, a connecting chain 181, and a safety switch 19, as shown in FIG. FIG. 3 and FIG. 7. The motor 18 triggers the conveyor 16 to operate. The connecting chain 181 connects the conveyor 16 and the motor 18 therebetween. When the conveyor 16 operates abnormally, the connecting chain 181 lifts up the motor 18 to trigger the safety switch 19 to stop the washing device.

In the present embodiment, the conveyor 16 is composed of a plurality of longitudinal bars and a plurality of horizontal bars. The longitudinal bars extend along a rolling direction of the conveyor 16 and are arranged parallel and spacedly. Each of the horizontal bars connects two adjacent longitudinal bars therebetween. Horizontal bars of adjacent rows are staggered.

Figure 6:
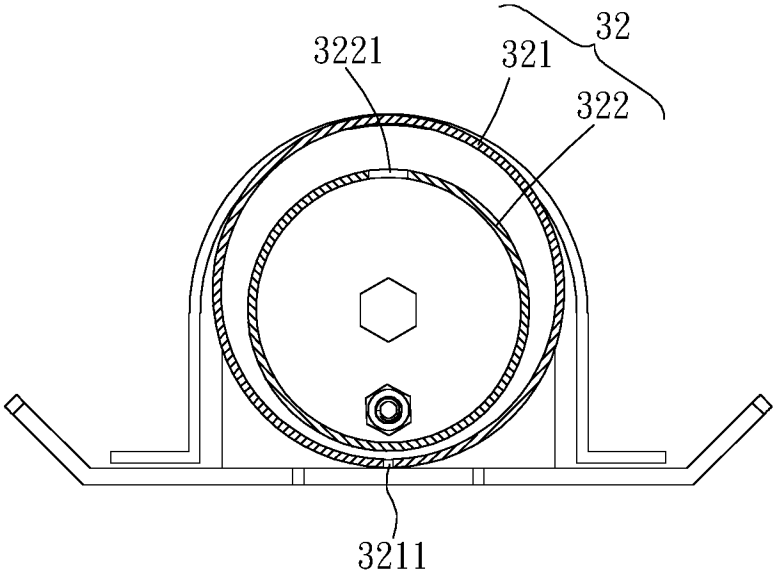
FIG. 6 is a profile showing a venting device of the present invention.
Figure 5:
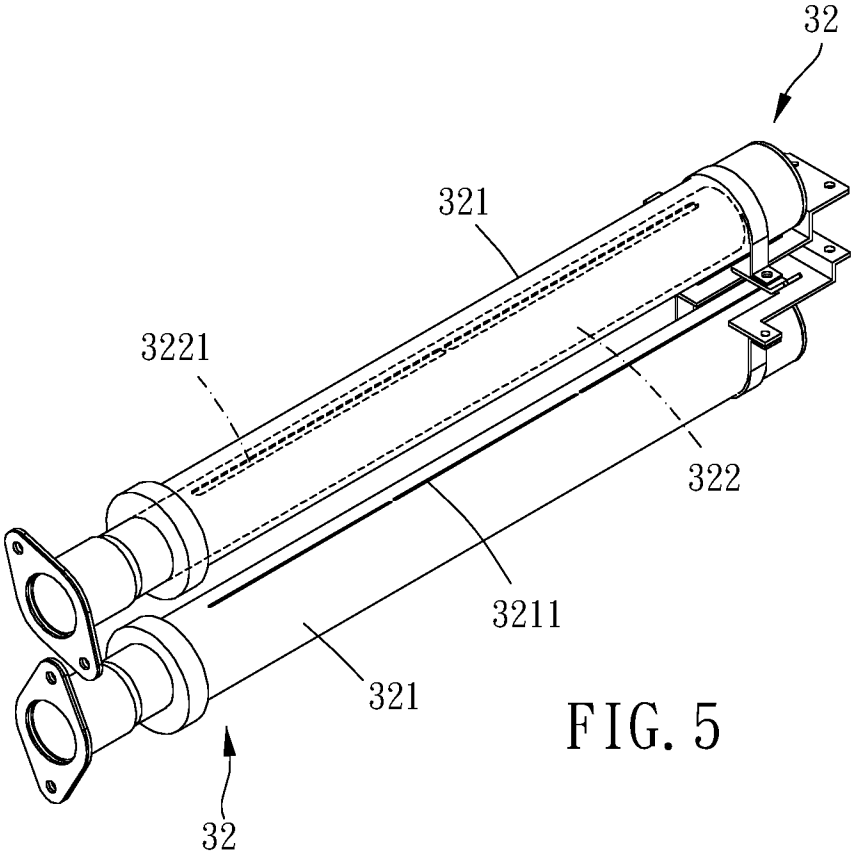
FIG. 5 is a stereogram showing venting devices of the present invention.
Figure 7:
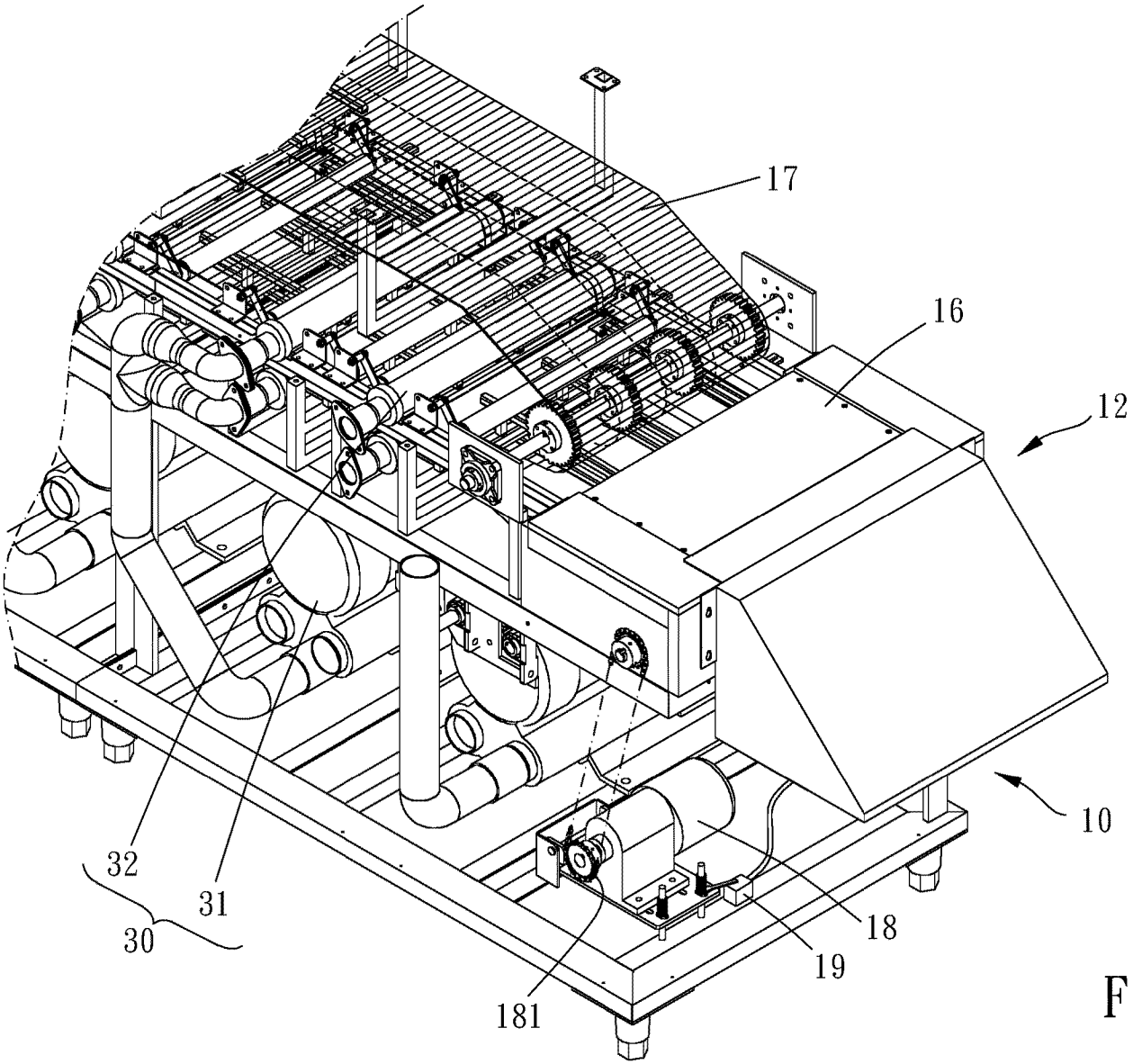
FIG. 7 is a partial stereogram of the present invention.

In view of the venting device, as shown in FIG. 5 and FIG. 6, the venting device 32 includes an outer cylinder 321 and an inner cylinder 322. The inner cylinder 322 is arranged in the outer cylinder 321 and is off-center with respect to the outer cylinder 321. The inner cylinder 322 is connected to the air supplier 31. Aside of the inner cylinder 322 remote from an inner wall of the outer cylinder 321 is formed with a first air outlet 3221. Aside of the outer cylinder 321 closer to an outer wall of the inner cylinder 322 is formed with a second air outlet 3211. The first air outlet 3221 and the second air outlet 3211 are away from each other. The second air outlet 3211 faces the drying zone 15. Thereby, the channel of air flow is tapered from the first air outlet to the second air outlet so as to accelerate the air flow to make air flow warmer for quick drying. Preferably, the drying system 30 includes at least two said venting devices 32 as a pair. Arrangements of the outer cylinder 321 and the inner cylinder 322 of the two venting devices 32 are opposite to each other. One of the venting devices 32 is arranged above the drying zone 15 wherein the second air outlet 3211 thereof faces downward. The other one of the venting devices 32 is arranged below the drying zone 15 wherein the second air outlet 3211 thereof faces upward. Practically, there can be plural pairs of the venting devices 32 arranged spacedly along the movement path of the object to be washed 50.

In addition, the washing device further includes a housing 40, as shown in FIG. 1. The housing 40 covers the main body 10 and has at least one observation window 41 for observing processes of washing or drying.

In use, the object to be washed 50, such as plates, is placed onto the conveyor 16 from the first end 11, and the object is brought to the first washing zone 13. In the first washing zone 13, the object is washed with water which is mixed with waste water from the first washing zone 13 and the second washing zone 14. The waste water is collected into the tank 22 for recycled use. The object is further moved into the second washing zone 14 to be washed with clean warm water to thoroughly clean up the object, and the waste water is collected into the tank 22 too. After finishing the process of washing, the object is further moved into the drying zone 15 and passes the pairs of venting devices 32 one by one for drying. After finishing the process of drying, the object leaves the conveyor 16 at the second end 12 and can be stacked with other washed objects. Thus, plural objects can be washed, dried, and stacked continuously.

When the conveyor 16 is stuck or damaged, the motor 18 is lifted to trigger the safety switch 19 so that the washing device is stopped for safety. In addition, users can observe the process of washing or drying from the observation windows 41.

What is claimed is:

1. A washing device, including:

a main body, having a first end and a second end, including a first washing zone, a second washing zone, and a drying zone from the first end to the second end, the main body having a transporting device to transport an object to be washed from the first end toward the second end so that the object to be washed passes through the first washing zone, the second washing zone, and the drying zone, the first washing zone having at least one first water outlet, the second washing zone having at least one second water outlet;

a water system, including a heater, a tank, a first pipe, a second pipe, and a collecting structure, the heater being connected to a water source to heat up water, the first pipe and the second pipe being connected to the heater respectively, an other end of the first pipe being connected to the tank, the tank being connected to the first water outlet via an outlet pipe, an other end of the second pipe being connected to the second water outlet, the collecting structure collecting waste water from the first washing zone and the second washing zone and injecting into the tank;

a drying system, including an air supplier and at least one venting device, the venting device being arranged at the drying zone of the main body and being connected to the air supplier so as to supply air flow to the drying zone for drying the object to be washed;

wherein the venting device includes an outer cylinder and an inner cylinder, the inner cylinder is arranged in the outer cylinder and is off-center with respect to the outer cylinder, the inner cylinder is connected to the air supplier, a side of the inner cylinder remote from an inner wall of the outer cylinder is formed with a first air outlet, a side of the outer cylinder closer to an outer wall of the inner cylinder is formed with a second air outlet, the first air outlet and the second air outlet are away from each other, the second air outlet faces the drying zone.

2. The washing device of claim 1, wherein the water system further includes a filtering device, a first motor, and a second motor, the filtering device and the first motor are disposed on the outlet pipe, the second motor is disposed on the second pipe.

3. The washing device of claim 1, wherein the tank has a water level detector, the water level detector triggers the first pipe to close to prohibit water from flowing into the tank from the heater when a water level is higher than a predetermined amount.

4. The washing device of claim 3, wherein the water system further includes a third pipe which is independent from the first pine, the third pipe connects the heater and the tank therebetween in order to manually add more water into the tank from the heater.

5. The washing device of claim 1, wherein the transporting device includes a conveyor and a pressing net, the pressing net is rollably arranged above the conveyor to press the object to be washed to move following the conveyor.

6. The washing device of claim 5, wherein the transporting device further includes a motor, a connecting chain, and a safety switch, the motor triggers the conveyor to operate, the connecting chain connects the conveyor and the motor therebetween, the connecting chain lifts up the motor to trigger the safety switch to stop the washing device when the conveyor operates abnormally.

7. The washing device of claim 5, wherein the conveyor is composed of a plurality of longitudinal bars and a plurality of horizontal bars, the longitudinal bars extend along a rolling direction of the conveyor and are arranged parallel and spacedly, each of the horizontal bars connects two adjacent longitudinal bars therebetween, horizontal bars of adjacent rows are staggered.

8. The washing device of claim 1, wherein the drying system includes at least two said venting devices, arrangements of the outer cylinder and the inner cylinder of the two venting devices are opposite to each other, one of the venting devices is arranged above the drying zone wherein the second air outlet thereof faces downward, the other one of the venting devices is arranged below the drying zone wherein the second air outlet thereof faces upward.

9. The washing device of claim 1, further including a housing, the housing covering the main body and having at least one observation window for observing processes of washing or drying.

* * * * *